US011415352B2

(12) United States Patent
Sonoda

(10) Patent No.: US 11,415,352 B2
(45) Date of Patent: Aug. 16, 2022

(54) APPARATUS FOR IMPROVED ICE MELTING PROCESS IN AN ICE STORAGE BIN

(71) Applicant: Naoki Sonoda, Palatine, IL (US)

(72) Inventor: Naoki Sonoda, Palatine, IL (US)

( * ) Notice: Subject to any disclaimer, the term of this patent is extended or adjusted under 35 U.S.C. 154(b) by 162 days.

(21) Appl. No.: 16/748,768

(22) Filed: Jan. 21, 2020

(65) Prior Publication Data

US 2020/0248946 A1 Aug. 6, 2020

Related U.S. Application Data

(60) Provisional application No. 62/799,918, filed on Feb. 1, 2019.

(51) Int. Cl.
*F25C 5/04* (2006.01)
*F25C 5/182* (2018.01)

(52) U.S. Cl.
CPC ..... *F25C 5/04* (2013.01); *F25C 5/182* (2013.01); *F25C 2600/02* (2013.01); *F25C 2600/04* (2013.01); *F25C 2700/04* (2013.01); *F25C 2700/14* (2013.01)

(58) Field of Classification Search
CPC ..... F25C 5/04; F25C 5/182; F25C 2600/02; F25C 2600/04; F25C 2700/04; F25C 2700/14
See application file for complete search history.

(56) References Cited

U.S. PATENT DOCUMENTS

| | | | | |
|---|---|---|---|---|
| 3,908,391 | A | 9/1975 | Wulke | |
| 5,090,214 | A * | 2/1992 | LoGioco | F25D 3/08 62/457.7 |
| 5,165,255 | A | 11/1992 | Alvarez | |
| 5,397,032 | A * | 3/1995 | Landers | F25D 31/002 222/146.6 |
| 5,797,514 | A | 8/1998 | Twiggar | |
| 6,093,312 | A | 7/2000 | Boulter | |
| 6,425,259 | B2 | 7/2002 | Nelson | |
| 6,685,053 | B2 | 2/2004 | Hawkes | |
| 7,080,525 | B2 | 7/2006 | McCann | |
| 8,522,566 | B2 | 9/2013 | LeClear | |
| 9,017,485 | B2 | 4/2015 | Murthy | |
| 2007/0169824 | A1 * | 7/2007 | Ro | F16K 15/147 137/614.2 |
| 2009/0142225 | A1 | 6/2009 | Tornqvist | |
| 2013/0037114 | A1 * | 2/2013 | Sudhalkar | E03B 7/071 137/596.12 |
| 2015/0135763 | A1 | 5/2015 | Lee | |
| 2016/0370061 | A1 * | 12/2016 | Erbs | A61L 2/183 |
| 2017/0114913 | A1 * | 4/2017 | Pearson | F16K 1/12 |
| 2018/0207305 | A1 * | 7/2018 | Almblad | A61L 2/20 |

* cited by examiner

*Primary Examiner* — Elizabeth J Martin
(74) *Attorney, Agent, or Firm* — Maheen Baber; MBIP Law LLC

(57) ABSTRACT

An apparatus for melting ice comprising an ice bin structure containing ice. The ice bin structure comprising a housing with four walls, a floor, and optionally four supporting legs, a nozzle assembly structure comprising a pipe as well as a head structure, wherein the head structure is oriented at a downward angle; a drainage means situated at the floor of the housing structure; and a removable cover oriented to comprehensively fit the open top of the housing.

14 Claims, 4 Drawing Sheets

APPARATUS FOR IMPROVED ICE MELTING PROCESS IN AN ICE STORAGE BIN

CROSS REFERENCE TO RELATED APPLICATION

This application claims the benefit of U.S. Provisional Application No. 62/799,918 filed on Feb. 1, 2019, the disclosure of which is incorporated herein by reference.

BACKGROUND

Field of the Invention

The present invention generally relates to ice storage bins and more specifically relates to an apparatus that serves to improve upon and expedite the ice melting process in an ice storage bin.

Description of the Related Art

Ice has long been provided in many forms to meet various commercial demands. Ice is widely and popularly used, for example, in supermarkets, restaurants, bars, hotels, marinas, recreational centers, and other facilities. One facility where ice bins or ice makers are commonly used is in kitchens of fast food restaurants as well as bars. Generally, sizable quantities of particulate ice are stored within a bin to facilitate the availability of the ice, so that the amount of ice needed in a given instance may be removed from the bin. Once ice has been made, such particles usually reside within a holding bin until dispensed. Further, once the ice has served its purpose it needs to be melted to prevent any risk of contamination, particularly in the food and service industry. The main cause of ice in restaurants, bars and hotels becoming contaminated is human error: improper ice handling. Contaminated ice can cause food borne illness and injury, and restaurants and bars want to try their utmost to decrease the chance of such a mishap occurring.

Today, foodservice workers manually "burn" or melt ice by using a container (food storage container, buckets, blender pitchers, water pitchers) to collect water at a faucet, transport it to an ice bin, and pour it inside the ice bin. They repeat this process until the ice has been completely melted. Another method utilized is to remove a majority of the ice with a container, and then melt the remaining ice with water, as explained above. Furthermore, users may also have to manually churn or swirl the ice at certain time increments to aid in the ice melting process. This can be a time consuming process, particularly in an industry where time is of the essence. Therefore, the problem of ice melting efficiently in commercial ice-storage bins has never been fully solved.

Thus, what is required is a method to eliminate the chance of any contamination and also improve the efficiency of such ice melting process.

Statement of the Objectives

Accordingly it is an objective of the current invention to overcome the deficiencies of the prior art.

It is also an object of the present invention to provide a novel ice melting process in an ice bin.

It is a further objective of the invention to create a circular movement of liquid similar to a whirlpool or vortex in the ice bin.

Another object of the invention is eliminate any risk of contamination of ice.

It is a further objective of the invention to provide an automatic means of melting ice without human intervention.

Another objective of the invention is to improve food safety and sanitary processes by providing for easy and effective cleaning of ice bins.

A further objective of the invention is to make cleaning ice bins more time efficient.

Another objective of the invention is to reduce water waste.

Still a further objective of the invention is to create a mechanically simple invention and reduce production costs.

It is a further objective of the invention to convert standard ice bins into ice bins with ice melting capabilities.

Other objects and advantages of the present invention will be set forth in part in the description and in the drawings that follow and, in part, will be obvious from the description, or may be learned by practice of the invention.

SUMMARY

Embodiments of the present invention provide a means for melting ice in an ice bin having improved efficiency, and mechanical simplicity for reduced production costs.

Accordingly, the present invention discloses an improved design for an ice bin with ice melting capabilities. The invention has as its principal objects to provide a simple yet effective means of achieving ice melting while minimizing any risk of contamination. The objects of the invention are achieved by the provision of an ice bin structure comprising a housing with four walls, a floor, and four supporting legs a nozzle assembly structure, the nozzle assembly structure comprising a pipe as well as a frontal head structure, wherein the frontal head structure resides completely inside the housing structure and at a downward angular orientation, a drainage means situated at the floor of the housing structure, and a removable cover structure.

In accordance with embodiments of the invention the angle of downward orientation of the nozzle assembly head is between 30 and 80 degrees and preferably closer to 30-60 degrees.

In another embodiment of the invention the downward orientation of the nozzle assembly with the ejecting water creates a circular motion of the liquid, such circular motion resulting in the melting of ice.

In a further embodiment of the invention a shutoff valve is connected to the nozzle assembly structure In yet another embodiment of the invention the shutoff valve is located remotely to reduce the size of the nozzle assembly structure.

In still a further embodiment of the invention at least one sensor is placed with in the housing of the ice bin to determine the water level and/or temperature within the housing.

In another embodiment of the invention a timer is placed on the shutoff valve to allow the valve to turn off when a certain pre-determined amount of water is injected into the bin via the nozzle assembly head.

In a further embodiment of the invention the nozzle assembly structure is removably attached to the outer peripherals of the walls of the ice bin housing.

In yet another embodiment of the invention the nozzle head is removably attached to the top of one of the walls of the housing structure via a mechanical means of attachment such as a clamp or a screw.

In another embodiment of the invention the nozzle head is bored into a wall of the housing structure.

Reference in the specification to one embodiment or an embodiment means that a particular feature, structure or characteristic described in connection with the embodiment is included in at least one embodiment of the invention. The appearance of the phrase "in one embodiment" in various places in the specification do not necessarily refer to the same embodiment.

Additional aspects of the invention will be set forth in part in the description which follows, and in part will be obvious from the description, or may be learned by practice of the invention. The aspects of the invention will be realized and attained by means of the elements and combinations particularly pointed out in the appended claims. It is to be understood that both the foregoing general description and the following detailed description are exemplary and explanatory only and are not restrictive of the invention, as claimed.

The present invention will now be described with reference to the following drawings, in which like reference numbers denote the same element throughout.

BRIEF DESCRIPTION OF THE DRAWINGS

Various exemplary embodiments of the methods of this invention will be described in detail with reference to the following figures, wherein.

DETAILED DESCRIPTION

Embodiments of the present invention are described more fully below with reference to the accompanying drawings, which form a part hereof, and which show exemplary embodiments for practicing the invention. However, embodiments may be implemented in many different forms and should not be construed as limited to the embodiments set forth herein; rather these embodiments are provided so that this disclosure will be thorough and complete, and will fully convey the scope of the invention to those skilled in the art. The following detailed description is, therefore, not to be taken in the limiting sense.

Figure 1:
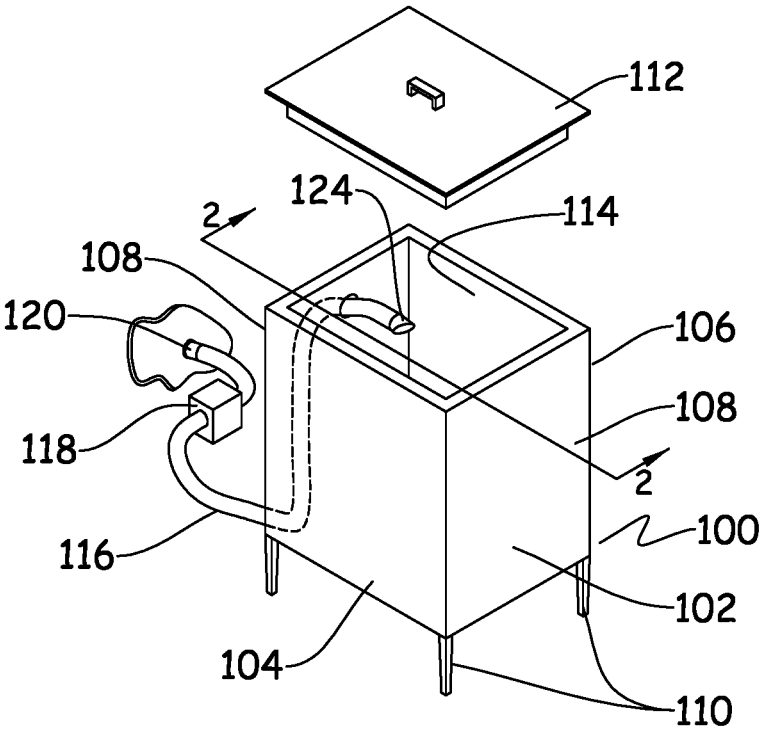
FIG. 1 is a front, perspective view of a preferred embodiment of an ice bin according to this invention.

Referring now to the embodiment illustrated in FIG. 1, the figure illustrates generally an ice bin 100, having a housing 102, comprising four walls, a front wall, 104, a back wall, 106 and a pair of side walls, 108, as well as optionally four legs, 110, the legs supporting the ice bin in an upright position. In an alternative embodiment of the invention, the ice bin, 100, does not have supporting legs but has a housing, 102, that drops into a countertop like a sink.

The inside of the housing, 102, is preferably insulated. The housing, 102, may be constructed of rigid non corrosive material such as stainless steel. The top compartment of the ice bin, 114, is open, providing an access means for facilitating insertion of, or optional removal of the ice. Further, an ice bin cover 112, is provided to comprehensively cover the top opening of the ice bin. The cover, 112, also provides access means to the ice bin, 100, for the addition of, or removal of ice manually, should such a need arise. In another embodiment of the invention, the cover 112, may not be removable but would be attached to the top opening of the ice bin, 100, and would comprise a sliding mechanism where half of the cover, 112, slides open to reveal the inside of the ice bin. A nozzle assembly structure, comprising a pipe, 116, is shown to be displayed close to the ice bin, 100.

The pipe, 116, is oriented such so as to penetrate the bottom end of one of the side walls, 108, run upwards through one of such sidewalls, 108, and close to the top of such side wall, 108, exit the wall perpendicularly to meet a nozzle assembly head structure, 124, wherein such nozzle head structure, 124, is oriented in a downward direction. The nozzle assembly head structure, 124, is completely residing inside the ice bin, 100. The pipe, 116 delivers fresh water to the nozzle assembly head. The pipe 116, is connected to the building water supply, 120, like any normal plumbing fixture. A backflow preventer, 118, is placed in the water supply line to prevent any backflow or contamination to the water supply, should a siphon occur. Also, a shutoff valve (not displayed) is mounted in an easily accessible location, on either the pipe, 116, close to the nozzle assembly head, 124, or remotely, allowing the water to be turned on or off depending upon the requirement at that particular time.

Figure 2:
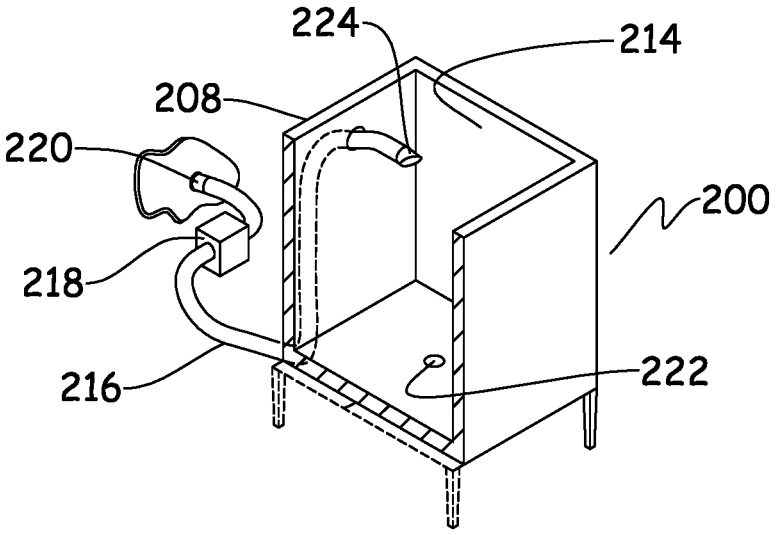
FIG. 2 is a cross sectional view of the first embodiment of the ice bin taken along lines 2-2 of FIG. 1.

FIG. 2, which is a cross-sectional view of the embodiment of FIG. 1 along the lines 2-2, displays the nozzle assembly head structure, 224, inside of the ice bin, 200. The ice bin 200, has the nozzle assembly head structure, 224, directed towards the ice in the ice bin, 200, in a downward orientation. The top compartment, 214, of the ice bin, 200, is displayed in an open position. The nozzle assembly head structure, 224, is connected to its corresponding pipe, 216, which brings a steady stream of water to the nozzle assembly head structure, 224, the water being directed at a downward angle of inclination to the ice situated on the floor of the housing. The pipe, 216, is further connected to a building water supply, 220, and may have a back flow preventer, 218, to prevent back flow or contamination of the water supply.

This angle of inclination at which the water strikes the ice in the ice bin, 200, may vary anywhere between 30-80 degrees. But for optimal results, the nozzle assembly head, 224, is preferably inclined between 30-60 degrees. By constantly striking the ice situated on the floor of the ice bin, at such an angle, the steady stream of water initially causes agitation in the water, eventually resulting in the creation of a circular motion of the liquid within the ice bin, similar to a whirlpool. How this works is that firstly, the constant stream of water hitting the ice causes a raising of the temperature of ice, initially starting the melting process. From there on, the steady jet steam of water at an angle initiates a circular movement in the liquid. This occurs because the melting ice causes water to sink underneath it. This in turn draws in some of the warm water from the top edges. The water coming in from the edges causes a further spinning motion. The steady jet stream is further causing melting as well as providing warmer water to continue the motion. Such a circular motion further expedites the melting of the ice without any human intervention.

Typically in a bar setting, a human subject has to manually swirl or stir the ice by hand in such a circular motion in order to raise the temperature of ice and to break up chunks of ice, and hence allow the melting of the contaminated ice, but in such an embodiment as the present invention, the human factor is eliminated. By the flow of the stream of water from the nozzle at a fixed angle of inclination, such a circular motion is naturally created, thereby expediting the melting of the ice and allowing the human subject to focus his or her attention on other relevant tasks.

Furthermore, a drainage means, 222, is provided at the bottom of the floor of the ice bin, allowing the removal of any melted ice. Such a drainage means, 222, eliminates any standing water and makes cleaning of the ice bin easier, thus allowing users to return contaminated ice bins to a safe and usable state significantly faster. A squeegee (not shown) the exact width of the inside of the ice bin, 200, may be included so that debris removal is quick and efficient. A squeegee would further allow the elimination of any standing water, by pushing it down the drainage means, 222, and out of the ice bin, hence making the ice bin cleaning process easier. The drainage means, 222, is left uncovered to firstly allow all melt water to seep out of the ice bin, 200, thus preventing any accumulation of standing water. Further, during the ice melting process the uncovered drainage means encourages the vortex or circular motion of the melting water to continue.

Moreover, in another embodiment of the invention, a timer could be inserted on top of or close to the shutoff valve (not displayed). Such a timer would allow the water from the nozzle assembly head, 224, to flow for a pre-determined amount of time. This determination of how long the flow of water from the nozzle assembly head is, can be based upon different factors, for example, the volume and capacity of the ice-bin, what volume of water is required to create the circular stream, how fast the flow of water is from the nozzle, etc. Once such a determination has been made and the timer has been preset, upon reaching that predetermined time, when the timer goes off, the shutoff valve is switched to the closed/off position (either manually, or automatically by built in sensors), and this prevents any further flow of water. This effectively limits the amount of time that the water flows into the bin thus providing a means to effectively regulate the waste of water. Furthermore, only as much water is being utilized that ensures that there is enough agitation in the liquid to initiate the circular whirlpool and start the ice melting process.

In addition to this, a further embodiment of the invention would also allow a sensor to be incorporated in the invention. Such a sensor may be installed on one of the internal walls of the ice bin, 200. The sensor may provide constant readings of the volume, temperature and height of water in the ice bin. When the water level reaches a certain height the sensor may generate a warning or alarm. This warning would either allow a user to manually turn the shut off valve into a closed position. Or alternatively, the sensor could automatically signal to the shutoff valve to cease the flow of water. When the water level is below a certain limit, due to perhaps continuous drainage, the sensor may send another signal to allow the flow of water again from the shutoff valve. This incorporation of a sensor would ensure that at all times the volume of water in the ice bin, 200, is enough for the creation of a circular flow, however, the quantity of water never exceeds a certain tipping point so as to cause the ice bin to overflow. Incorporation of such a sensor would also further ensure that water waste is eliminated to a great degree.

Figure 3:
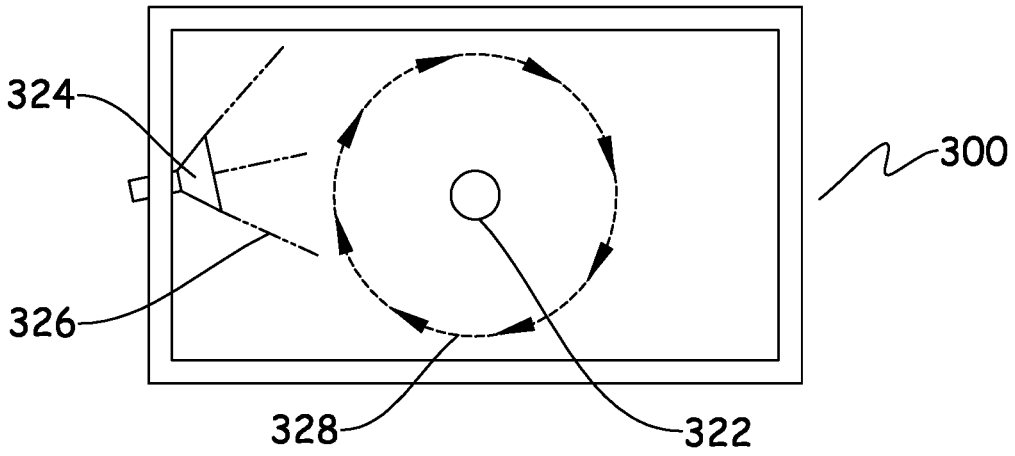
FIG. 3 is a top aerial view of the first embodiment of FIG. 1.

Referring now to FIG. 3, an aerial view of the circular movement of the liquid, 328, in the ice bin, 300, is depicted, wherein the constant flow of water, 326 from the nozzle assembly head structure, 324, aids in such a constant circular movement. The drain, 322 at the center of the floor of the bin, 300, aids in the removal of any melted ice as well as the creation of the circular motion or vortex.

The creation of liquid agitation and eventual circular movement by the bearing of water on the ice, at an angular orientation, means that a human subject now no longer has to manually carry multiple pitchers of water to the ice bin to melt the ice manually.

Figure 4:
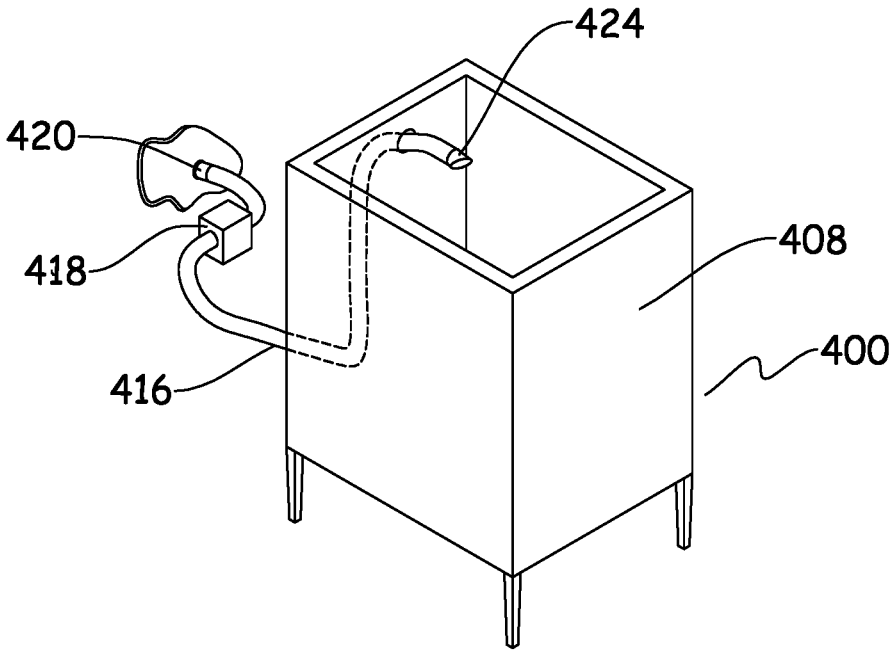
FIG. 4 is front perspective view of a second embodiment of an ice bin.

FIG. 4 depicts a second embodiment of the invention, wherein an existing ice bin 400, with a housing, 408, comprising four walls and a bottom floor, can be converted into an ice bin with ice melting capabilities. This can be achieved by the use of a pipe, 416, attached to the nozzle assembly head structure, 424, as well as a shut off valve (not depicted). Again, the pipe would be attached to a building water supply, 420, and a back flow preventer, 418, would be incorporated to prevent any contamination of the water supply. Various ways and means by which the nozzle assembly can be secured to the ice bin, 400, will be disclosed in detail below.

The nozzle assembly head structure, 424 would be tilted inside of the bin, 400, in a downward orientation, as disclosed above, to create a whirlpool, vortex or circular motion within the ice bin, thereby expediting the water melting process. By incorporation of such an embodiment of the invention into an existing ice bin, a user can convert any existing ice bin into an ice bin with ice melting capabilities without human intervention. This would thereby allow the foregoing of any expenses with replacement of otherwise functioning ice bins.

In order to duplicate this second embodiment, a user would have to connect a hose to a sink faucet, direct that hose to the ice bin, and secure the end of the hose so that it remains inside of the ice bin. Most health departments in the United States require that bars have at least 2 sinks: a dedicated sink for hand-washing (hand-wash sink) and a sink for discarding any wet waste from finished drinks (dump-sink). If a foodservice worker connected a hose to the faucet of a hand-wash sink to melt ice, that hand-wash sink would be out of service for the duration of the ice melting process (the same would hold true if the user used the dump-sink faucet to connect the hose to). This creates a condition where the foodservice operation is temporarily out of compliance with code, which then results in potential health risks. Users would then be forced to wash their hands over a dump ink, or use a hand-wash sink to discard wet waste, and these would be considered unsanitary practices. This embodiment eliminates the need for one to connect a hose to a faucet, as it provides a permanent water source for the ice bin, should it need to be cleaned. Furthermore, this Second Embodiment also eliminates a scenario where a hose would be laying on the floor during an ice bin cleaning. This is a tripping hazard-a potential liability issue for an operator. It is also a sanitation issue-a foodservice worker handling a hose that has contacted a floor is unsanitary practice.

Figure 5:
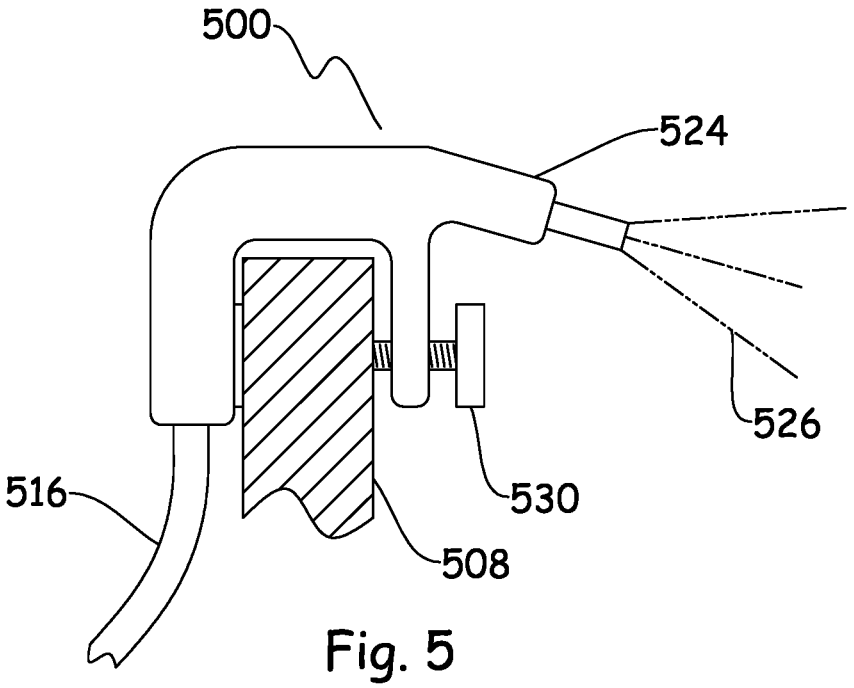
FIG. 5 is an enlarged overall side view of the nozzle assembly in a second embodiment of the invention.

FIG. 5. depicts an enlarged overall side view of the nozzle assembly, 500, in a second embodiment of the invention. The nozzle assembly head structure, 524, is mechanically affixed to a wall, 508 of an ice bin. Further this nozzle assembly head, 524, is connected to the water supply of the building via the pipe, 516, to provide a constant source of water when it is needed. The jet stream of water, 526, exiting from the nozzle assembly head structure, would be at an angular inclination, as discussed above. The head structure, 524, would be secured to the sidewall of the ice bin with a clamp, 530. Instead of a clamp or a thumbscrew, some other mechanical means may be utilized that maintains enough tension between the sidewall and nozzle assembly to keep it firmly attached to the wall, 508, of the ice bin. The clamp, 530, can be loosened to allow the removal of such head structure, 524, from the ice bin for cleaning of the ice bin and the head structure itself.

Further, the head structure, 524, is made of rigid material, such material allowing the head structure to remain firmly in place over the ice bin, however, the nozzle angle would still be adjustable.

Figure 6:
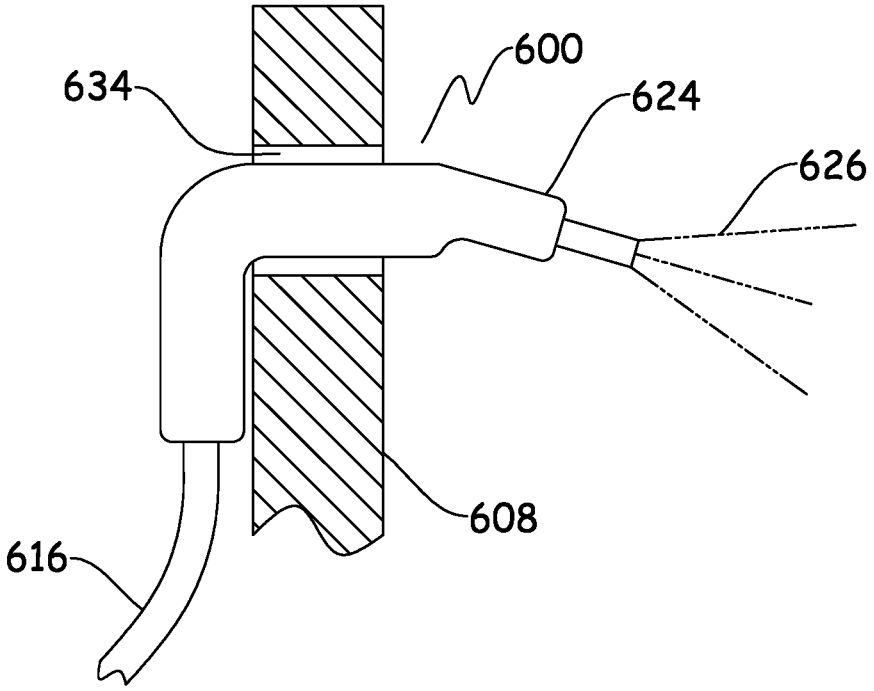
FIG. 6 is a side view of an alternative way of mounting the nozzle in a second embodiment of the invention.

FIG. 6 depicts a side view of an alternative way of mounting the nozzle assembly, 600, in a second embodiment of the invention. In this embodiment the nozzle assembly head structure, 624, is inserted into the wall, 608 of an ice bin by means of a hole, 634, cut into the wall, 608, of the ice bin. Further this nozzle assembly, 600, is connected to the water supply of the building, via the pipe, 616, to provide a constant source of water when it is needed. The jet stream of water, 626, exiting from the nozzle assembly head structure, 624 would be at an angular inclination, as discussed above. Once the ice melting purpose is achieved and to clean the nozzle assembly head structure, 624, the nozzle assembly, 600, can be removed from the ice bin, by extracting the nozzle assembly head structure, 624, from the hole, 634. Again, even though the head structure, 624, is made of rigid material, the angle or orientation of such structure is adjustable. A shutoff valve would also be provided to such a nozzle assembly, 600, to control the flow of water to the ice bin. A backflow preventer would also be attached to the pipe, 616, to protect the water supply if there is a siphon.

Figure 7:
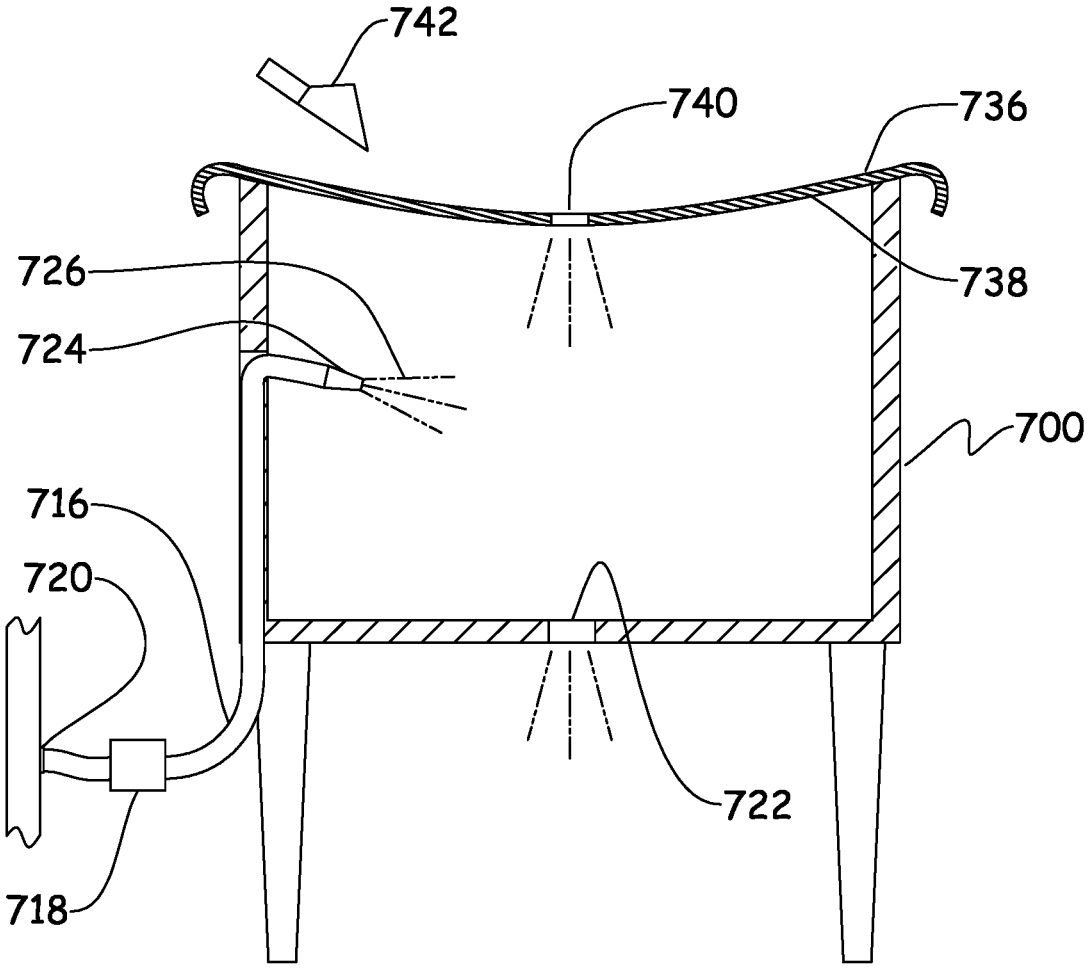
FIG. 7 is a vertical sectional view of a third embodiment of the invention.

FIG. 7 depicts a vertical sectional view of a third embodiment of the present invention. This embodiment consists of one or more portable ice bins, 736, that can be suspended above a contaminated ice bin, 700, while it is undergoing the ice-melting process. Such an embodiment allows foodservice workers to continue serving consumable ice safely, while contaminated ice is being melted in the ice bin, 700. This saves significant time during service. The portable ice bin, 736, is suspended over an ice bin, 700, with a base, 738, that spans the width of the permanent ice bin, 700. The base, 738, of the portable ice bin has a drain, 740, so that melting water can drain into the contaminated ice bin, 700, below it. A further drainage means, 722 is situated in the ice bin, 700, to allow the drainage of all contaminated water. The portable ice bin, 736, may also have an ice scoop holder, 742, and is designed to be dishwasher safe. The ice scoop holder, 742, is designed to insert or remove any ice without any human contact and therefore reduce the risk of contamination. In the ice bin below the nozzle assembly head, 724, would be directing a stream of water, 726 towards any contaminated ice in the ice bin, 700, allowing further ice melting to take place. In this embodiment of the invention, the nozzle assembly head, 724 is shown to be permanently attached to the ice bin, however, it may also be removably attached as described in embodiment two. The pipe, 716 of the nozzle assembly is attached to the building water supply, 720 and a back flow preventer, 718 is situated on such a pipe, 716.

The portable ice bins, 736, would be stored near ice-making machines, so they could be quickly deployed when an ice bin needs to be cleaned during service due to a contamination (or suspected contamination).

Such a portable ice bin, 736, provides the additional benefits that it allows foodservice workers to continue working and serving drinks while contaminated ice is being melted. Further, it encourages foodservice workers to follow best practices, and properly clean an ice bin whenever there is a shadow of doubt about the ice being contaminated. In general this increases food safety for the general public It will be understood from a reading of the detailed description of the preferred embodiments, the objects of the invention and the appended claims that further modifications of the present invention may be made consistent with the scope of the subject matter as taught by the present invention which is to be broadly construed in view of the claims appended hereto. Further, while particular details of construction of various components of the apparatus are disclosed herein, various alternative arrangements may be employed. Other modifications and changes in construction of the various components of this invention may also be modified within the spirit and scope of the invention as recited in the appended claims.

I claim:

1. An apparatus for melting ice comprising:

a. An ice bin structure containing ice, the ice bin structure comprising a housing with four walls, a floor, and optionally four supporting legs;

b. A nozzle assembly structure comprising a pipe as well as a head structure, wherein the head structure is oriented at a downward angle, further wherein the head structure directs a steady jet stream of water towards ice located in the housing of the ice bin, wherein the angle of orientation of the head structure is between 30-60 degrees, such angle of orientation causing a circular motion of liquid to formulate;

c. A drainage situated at the floor of the housing structure; and d. A removable cover oriented to comprehensively fit the open top of the housing.

2. The apparatus of claim 1, wherein the internals of the housing are insulated.

3. The apparatus of claim 1, wherein the pipe is oriented such so as to penetrate the bottom end of one of the side walls, run upwards though such sidewall and close to the top of such wall, exiting the wall perpendicularly to meet the head structure.

4. The apparatus of claim 1, wherein the pipe is connected to a building supply line, such supply line further comprising a back flow preventer.

5. The apparatus of claim 1, wherein a shut off valve is mounted either on the pipe or in a remote location.

6. The apparatus of claim 1, wherein the formation of the circular motion causes further melting of the ice.

7. The apparatus of claim 1, wherein the nozzle assembly structure is removably attached to the outer peripherals of the walls of the housing.

8. The apparatus of claim 7, wherein the nozzle head is removably attached to the top of one of the walls of the housing structure via a clamp.

9. The apparatus of claim 8, wherein the nozzle head is made of rigid material but the nozzle angle is adjustable.

10. The apparatus of claim 7, wherein the nozzle head is removably attached to the housing structure via a hole bored into one of the walls of the housing structure.

11. The apparatus of claim 10, wherein the nozzle assembly head structure can be removed completely to clean it.

12. The apparatus of claim 1 further comprising a portable ice bin suspended over the ice bin structure, wherein the base of the portable ice bin spans the width of the ice bin structure.

13. The apparatus of claim 12, wherein the portable ice bin has a drainage means located at the base of such bin.

14. The apparatus of claim 12, wherein the portable ice bin is dishwasher safe.

* * * * *